US009409426B2

(12) United States Patent
Oba

(10) Patent No.: US 9,409,426 B2
(45) **Date of Patent: *Aug. 9, 2016**

(54) IMAGE FORMING APPARATUS, METHOD OF CONTROLLING TENSION OF RECORDING MEDIUM

(71) Applicant: SEIKO EPSON CORPORATION, Tokyo (JP)

(72) Inventor: Masashi Oba, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/669,875

(22) Filed: Mar. 26, 2015

(65) Prior Publication Data

US 2015/0197110 A1 Jul. 16, 2015

Related U.S. Application Data

(63) Continuation of application No. 14/204,635, filed on Mar. 11, 2014, now Pat. No. 9,033,489.

(30) Foreign Application Priority Data

Mar. 21, 2013 (JP) ..... 2013-058070

(51) Int. Cl.
*B41J 15/16* (2006.01)
*B41J 15/04* (2006.01)

(52) U.S. Cl.
CPC ..... *B41J 15/165* (2013.01); *B41J 15/042* (2013.01); *B41J 15/16* (2013.01)

(58) Field of Classification Search
CPC ..... B41J 15/165
IPC ..... B41J 15/16,15/165, 15/042, 15/044
See application file for complete search history.

(56) References Cited

U.S. PATENT DOCUMENTS 5,360,502 A * 11/1994 Andersson ..... 156/159
5,815,186 A * 9/1998 Lewis et al. ..... 347/101
9,033,489 B2 * 5/2015 Oba ..... B41J 15/165 347/104
2008/0031655 A1 2/2008 Kondo
2011/0285801 A1 11/2011 Okura et al.
2014/0285560 A1 9/2014 Oba et al.

FOREIGN PATENT DOCUMENTS

JP 10-086472 4/1998
JP 2011-011889 1/2011
JP 2014-180805 9/2014

* cited by examiner

*Primary Examiner* — Manish S Shah
*Assistant Examiner* — Jeffrey C Morgan
(74) *Attorney, Agent, or Firm* — Workman Nydegger

(57) ABSTRACT

An image forming apparatus includes a control unit that applies a tension to a recording medium in a first region between a rotational shaft and a driving roller using a torque applied to the rotational shaft and the driving roller, and applies a tension to the recording medium in a second region where a support member supports the recording medium using a torque applied to the driving roller and a holding unit. The control unit selectively executes an image forming mode where the head is caused to execute image forming by applying a tension to the recording medium in the second region while applying a tension to the recording medium in the first region, and a medium detaching mode where the tension in the first region is released when the recording medium is stopped, while applying a tension for detaching a medium to the recording medium in the second region.

7 Claims, 4 Drawing Sheets

IMAGE FORMING APPARATUS, METHOD OF CONTROLLING TENSION OF RECORDING MEDIUM

CROSS-REFERENCE TO RELATED APPLICATIONS

The present application is a Continuation of U.S. patent application Ser. No. 14/204,635 filed on Mar. 11, 2014, which claims priority to Japanese Patent Application No. 2013-058070, filed Mar. 21, 2013, which applications are expressly incorporated by reference herein.

BACKGROUND

1. Technical Field

The present invention relates to a technology of controlling a tension of a recording medium in an image forming apparatus which detachably holds the recording medium on which an image is formed on a rotational shaft by winding up the recording medium in a roll shape.

2. Related Art

A recording apparatus in JP-A-10-086472 records an image using a printing unit with respect to continuous paper which is supported by a transport drum which is arranged between two transport rollers, while transporting the continuous paper by rotating the two transport rollers which wind up the continuous paper. In addition, in an apparatus which performs image forming on a recording medium such as continuous paper, it is possible to transport the recording medium using a so-called roll to roll method. In the roll to roll method, rotational shafts are respectively provided at both ends of a transport path of the recording medium, and both ends of the recording medium are supported by the rotational shafts, respectively, by being wound in a roll shape. In addition, the recording medium is transported from a roll which is supported by one rotational shaft to a roll which is supported by the other rotational shaft. In addition, in general, the recording medium is detachably supported by the rotational shaft so as to be easily exchanged.

Meanwhile, it is preferable to stabilize a support of a recording medium using a support member by applying a large tension to the recording medium which is supported by the support member in order to perform good image forming with respect to the recording medium which is supported by the support member such as a transport drum. For this reason, the recording medium is stretched between two rollers which interpose the support member therebetween using a large tension. However, the large tension is not only generated by a torque of rollers which interpose the support member therebetween, and is also generated subsidiarily by a torque of rotational shafts which support both ends of the recording medium. Accordingly, when forming an image, such a large torque is not necessary in each of rollers interposing the support member therebetween.

On the other hand, when detaching the recording medium from the rotational shafts, since applying of the tension to the recording medium using a rotational shaft from which the recording medium is detached, the rotational shaft does not support a generation of the tension with respect to the recording medium which is supported by the support member any more. As a result, for example, there is a concern that a detaching work of the recording medium may not be smoothly performed, or the like, because the roller on a side of the rotational shaft of which support is lost, and from which the recording medium is detached cannot resist the tension which is originally applied to the recording medium on the support member, and the recording medium may deviate.

SUMMARY

An advantage of some aspects of the invention is to provide a technology in which a deviation of a recording medium when detaching the recording medium from a rotational shaft which supports the recording medium of a roll shape can be suppressed, while executing good image forming by applying a large tension to the recording medium.

According to an aspect of the invention, there is provided an image forming apparatus which includes a rotational shaft which detachably holds a recording medium which is wound in a roll shape; a support member which supports the recording medium which comes out from a portion wound in the roll shape; a head which faces the support member, and performs image forming on the recording medium; a driving roller which winds up the recording medium between the rotational shaft and the support member; a holding unit which holds the recording medium by winding up the recording medium on a side opposite to the driving roller with respect to the support member; and a control unit which applies a tension to the recording medium in a first region between the rotational shaft and the driving roller using a torque which is applied to the rotational shaft and the driving roller, and applies a tension to the recording medium in a second region in which the holding member supports the recording medium using a torque which is applied to the driving roller and the holding unit, in which the control unit selectively executes an image forming mode in which the head is caused to execute image forming by applying a tension for image forming to the recording medium in the second region while applying a tension to the recording medium in the first region, and a medium detaching mode in which the tension of the recording medium in the first region is released in a state of stopping the recording medium while applying a tension for detaching a medium which is smaller than the tension for image forming to the recording medium in the second region.

According to another aspect of the invention, there is provided a method of controlling a tension of a recording medium in an image forming apparatus which performs image forming using a head which faces a support member with respect to the recording medium which is supported by the support member by coming out from a portion which is wound in a roll shape, while detachably holding the recording medium which is wound in the roll shape on a rotational shaft, the method including applying a tension using a torque which is applied to the rotational shaft and a driving roller with respect to the recording medium in a first region between the driving roller which winds up the recording medium between the rotational shaft and the support member, and applying a tension for image forming with respect to the recording medium in a second region in which the support member supports the recording using a torque which is applied to a holding unit which holds the recording medium by winding up the recording medium on a side opposite to the driving roller with respect to the support member; and releasing the tension of the recording medium in the first region in a state of stopping the recording medium while applying a tension for detaching a medium which is smaller than the tension for image forming to the recording medium in the second region.

In the invention which is configured in this manner (image forming apparatus, and method of controlling tension of recording medium), the recording medium which is wound in a roll shape is detachably supported on the rotational shaft. In addition, a recording medium which comes out from a portion wound in the roll shape is supported by the support member. In addition, a driving roller which winds up the recording medium between the rotational shaft and the support member, and a holding unit which holds the recording medium by winding up the recording medium on a side opposite to the driving roller with respect to the support member are provided. Accordingly, a tension with respect to the recording medium in the first region between the driving roller and the rotational shaft is generated by a torque which is applied to the driving roller and the rotational shaft, and a tension with respect to the recording medium in the second region in which the support member supports the recording medium is generated by a torque which is applied to the driving roller and the holding unit.

In addition, a head performs image forming on the recording medium which is supported by the support member in a state in which the tension for image forming is applied to the recording medium in the second region, while a tension is applied to the recording medium in the first region. At this time, the tension for image forming is not only generated by the torque of the driving roller, but also subsidiarily generated by the torque of the rotational shaft. That is, the tension for image forming is applied to the recording medium when the torques of the driving roller and the rotational shaft resist the torque of the holding unit in collaboration. As a result, it is possible to apply a large tension for image forming to the recording medium which is supported by the support member without applying such a large torque to the driving roller, and to perform good image forming.

In addition, according to the aspect of the invention, it is possible to release the tension of the recording medium in the first region in a state of stopping the recording medium while applying a tension for detaching medium which is smaller than the tension for image forming to the recording medium in the second region (medium detaching mode). In the medium detaching mode, releasing of the tension of the recording medium in the first region is performed in a state in which a tension for detaching medium which is relatively small is applied to the recording medium in the second region. Accordingly, a tension to be resisted by the driving roller when releasing the tension of the recording medium in the first region is a tension for detaching medium which is relatively smaller than the tension form image forming. For this reason, it is possible for the driving roller to suppress a deviation of the recording medium by resisting the tension which is applied to the recording medium on the support member (tension for detaching medium), even when the driving roller looses the support from the rotational shaft along with releasing of the tension in the first region.

According to such an aspect of the invention, it is possible to perform good image forming by applying a large tension for image forming to a recording medium when performing image forming. On the other hand, when detaching the recording medium from a rotational shaft, it is possible to perform detaching of the recording medium while suppressing a deviation of the recording medium associated with releasing of a tension of the recording medium by executing a medium detaching mode. As a result, it is possible to suppress a deviation of the recording medium when detaching the recording medium from the rotational shaft which supports the recording medium which is wound in a roll shape, while performing good image forming by applying a tension for image forming to the recording medium which is supported by a support member.

The image forming apparatus may further include an external member which accommodates the rotational shaft; an opening-shutting door which opens or shuts an opening portion which is open to the rotational shaft, and is provided in the external member; and a locking mechanism which locks the opening-shutting door, in which the control unit may control the locking mechanism so that the opening-shutting door is locked until the tension of the recording medium in the first region is released, and the locking of the opening-shutting door is released after releasing the tension of the recording medium in the first region, during an execution of the medium detaching mode. With such a configuration, it is possible to prevent a worker from accessing the recording medium before the tension thereof is released. For this reason, it is possible to prevent the recording medium or the rotational shaft from being damaged when the worker tries to forcibly detach the recording medium before releasing tension from the rotational shaft, for example.

In the image forming apparatus, the control unit may lock the opening-shutting door during the execution of the image forming mode. With such a configuration, it is possible to prevent the worker from accessing the recording medium on which image forming is performed. For this reason, for example, it is possible to prevent the worker from disturbing the image forming on the recording medium by accessing the recording medium in the middle of image forming by mistake.

The image forming apparatus may further include an input unit which receives an input from the worker, in which the control unit may execute the medium detaching mode when the input unit receives an input instructing executing of the medium detaching mode. With such a configuration, it is possible to perform releasing of the tension of the recording medium by executing the medium detaching mode at an appropriate timing which corresponds to detaching of the recording medium by the worker. For this reason, it is possible for the worker to improve workability.

In the image forming apparatus, the control unit may apply the tension to the recording medium in the first region when the input unit receives an input denoting that exchanging of the recording medium with respect to the rotational shaft is completed, after executing the medium detaching mode. In this manner, for example, when the worker finishes an exchanging work of mounting a new recording medium on the rotational shaft by detaching the previous recording medium from the rotational shaft, it is possible to rapidly apply a tension to the recording medium in the first region, and to be prepared for image forming to be executed thereafter.

In the image forming apparatus, the control unit may apply the tension for image forming to the recording medium in the second region when the input unit receives an input denoting that exchanging of the recording medium with respect to the rotational shaft is finished, after executing the medium detaching mode. In this manner, for example, when the worker finishes the exchanging work of mounting a new recording medium on the rotational shaft by detaching the previous recording medium from the rotational shaft, it is possible to rapidly apply a tension to the recording medium in the second region, and to be prepared for image forming to be executed thereafter.

In the image forming apparatus, the control unit may transport the recording medium toward the holding unit from the driving roller while feeding the recording medium from the rotational shaft, in the image forming mode. With such a configuration, it is possible to suppress a deviation of the recording medium which is associated with releasing of tension of the recording medium when detaching the recording medium from the rotational shaft which feeds the recording medium.

In the image forming apparatus, the control unit may transport the recording medium toward the driving roller from the holding unit while winding the recording medium around the rotational shaft. With such a configuration, it is possible to suppress a deviation of the recording medium which is associated with releasing of tension of the recording medium when detaching the recording medium from the rotational shaft which winds up the recording medium.

In addition, for the control of the driving roller in the image forming mode, various modes can be taken into consideration. Therefore, the control unit may control a torque of the driving roller in the image forming mode. Alternatively, the control unit may control a rotating speed of the driving roller in the image forming mode.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
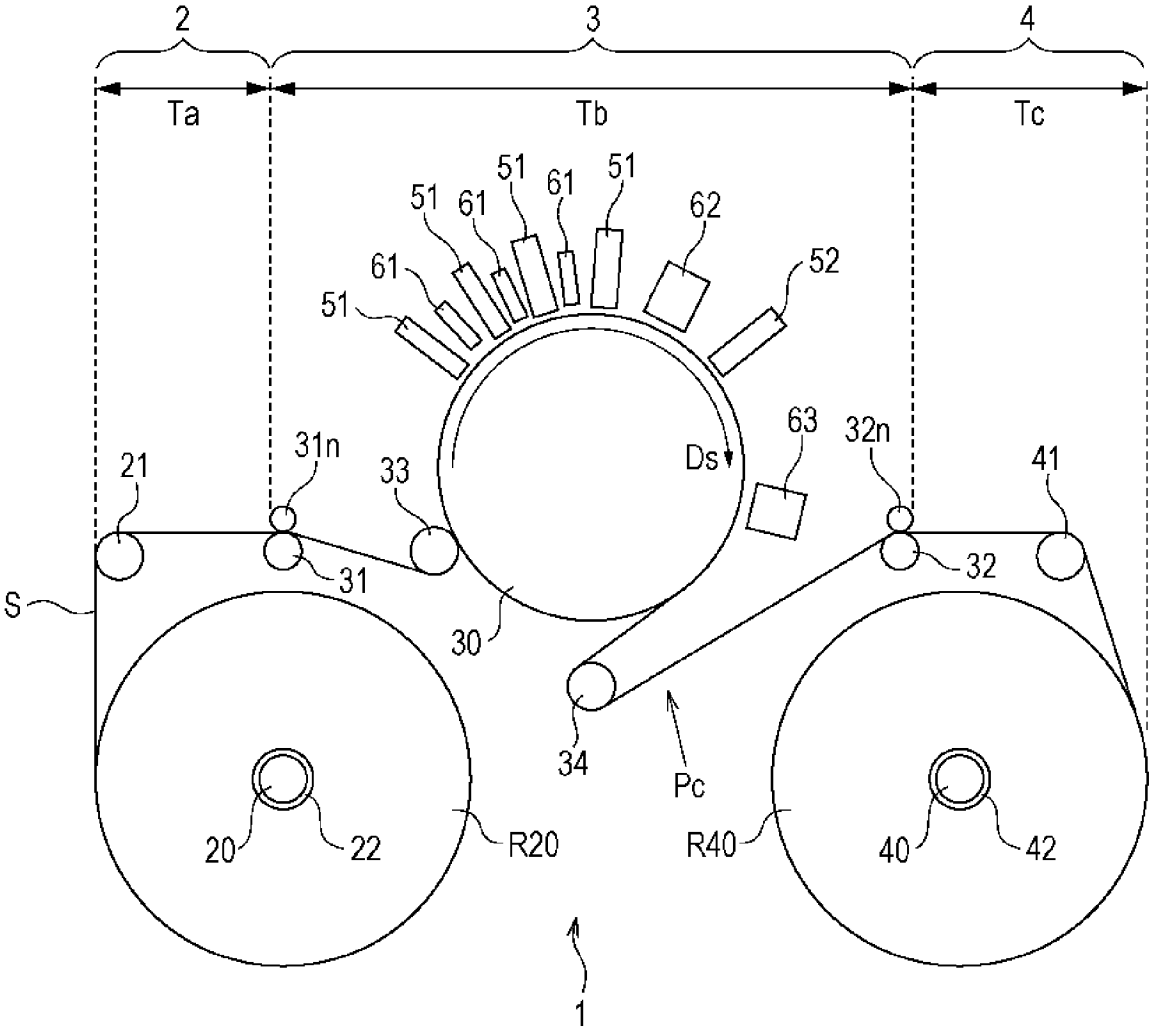
FIG. 1 is a front view which illustrates an internal configuration of a printer to which the invention can be applied.

FIG. 1 is a front view which schematically illustrates an example of an internal configuration of a printer to which the invention can be applied. As illustrated in FIG. 1, in a printer 1, one sheet S (web) of which both ends are wound in a roll shape around a feeding shaft 20 and a winding shaft 40 is stretched between the feeding shaft 20 and the winding shaft 40, and the sheet S is transported to the winding shaft 40 from the feeding shaft 20 along a transport path Pc which stretches in this manner. In other words, a feed roll R20 and a windup roll R40 are formed when the both ends of the sheet S in the transport path Pc are wound in a roll shape, respectively, and the sheet S is transported using a roll to roll method from the feed roll R20 which is pivotally supported by the feeding shaft 20 to the windup roll R40 which is pivotally supported by the winding shaft 40.

In addition, in the printer 1, an image is recorded with respect to the sheet S which is transported along the transport path Pc. A type of the sheet S is largely classified into paper types and film types. As a specific example, there is fine quality paper, cast coated paper, art paper, coated paper, or the like, for the paper types, and there is synthetic paper, Polyethylene terephthalate (PET), polypropylene (PP), or the like, for the film types. Schematically, the printer 1 includes a feeding unit 2 (feeding region) which feeds the sheet S from the feeding shaft 20, a process unit 3 (process region) which records an image on the sheet S which is fed from the feeding unit 2, and a winding unit 4 (winding region) which winds the sheet S on which an image is recorded in the process unit 3 around the winding shaft 40. In addition, in the following descriptions, a surface on which an image is recorded is referred to as the front surface, and on the other hand, a surface which is opposite to the front surface is referred to as the rear surface, regarding both surfaces of the sheet S.

The feeding unit 2 includes the feeding shaft 20 which winds an end of the sheet S, and a driven roller 21 which winds up the sheet S which is drawn out from the feeding shaft 20. The feeding shaft 20 supports the end of the sheet S by winding the sheet in a state in which the front surface of the sheet S is caused to face the outside. In addition, when the feeding shaft 20 rotates clockwise as illustrated in FIG. 1, the sheet S which is wound around the feeding shaft 20 is fed to the process unit 3 via the driven roller 21. Incidentally, the sheet S is wound around the feeding shaft 20 through a core tube 22 which is detachable from the feeding shaft 20. Accordingly, when the sheet S of the feeding shaft 20 is used up, it is possible to exchange the sheet S of the feeding shaft 20 by mounting a new core tube 22 on which a roll shaped sheet S (feed roll R20) is wound on the feeding shaft 20.

The process unit 3 performs recording of an image on the sheet S by appropriately performing processes using each of functional units 51, 52, 61, 62, and 63 which are arranged along the outer peripheral surface of a platen drum 30 while supporting the sheet S which is fed from the feeding unit 2 on the platen drum 30. The process unit 3 is provided with a front driving roller 31 and a rear driving roller 32 on both sides of the platen drum 30, and the sheet S which is transported from the front driving roller 31 to the rear driving roller 32 is supported by the platen drum 30, and has an image recorded thereon.

The front driving roller 31 includes a plurality of minute protrusions which are formed using thermal spraying on the outer peripheral surface, and winds up the sheet S which is fed from the feeding unit 2 from the rear surface side. In addition, the front driving roller 31 transports the sheet S which is fed from the feeding unit 2 to the downstream side of a transport path Pc by rotating clockwise as illustrated in FIG. 1. In addition, a nip roller 31*n* is provided with respect to the front driving roller 31. The nip roller 31*n* comes into contact with the front surface of the sheet S in a state of being urged to the front driving roller 31 side, and interposes the sheet S between the nip roller and the front driving roller 31. In this manner, a friction force between the front driving roller 31 and the sheet S is secured, and it is possible to reliably transport the sheet S using the front driving roller 31.

The platen drum 30 is a cylindrical drum of which a diameter is 400 mm, for example, is rotatably supported by a not shown support mechanism, and winds up the sheet S which is transported from the front driving roller 31 to the rear driving roller 32 from the rear surface side. The platen drum 30 supports the sheet S from the rear surface side while rotating in the transport direction Ds of the sheet S in a driven manner by receiving a friction force between the platen drum and the sheet S. Incidentally, the process unit 3 is provided with driven rollers 33 and 34 which replicate the sheet S on both sides of a winding portion with respect to the platen drum 30. The driven roller 33 in the driven rollers replicates the sheet S by winding up the front surface of the sheet S between the front driving roller 31 and the platen drum 30. On the other hand, the driven roller 34 replicates the sheet S by winding up the front surface of the sheet S between the platen drum 30 and the rear driving roller 32. In this manner, it is possible to secure a long winding portion of the sheet S with respect to the platen drum 30 by replicating the sheet S on the respective upstream side and downstream side in the transport direction Ds with respect to the platen drum 30.

The rear driving roller 32 includes a plurality of minute protrusions which are formed using thermal spraying on the outer peripheral surface, and winds up the sheet S which is transported from the platen drum 30 through the driven roller 34 from the rear surface side. In addition, the rear driving roller 32 transports the sheet S to the winding unit 4 by rotating clockwise as illustrated in FIG. 1. In addition, a nip roller 32*n* is provided with respect to the rear driving roller 32. The nip roller 32*n* comes into contact with the front surface of the sheet S in a state of being urged to the rear driving roller 32 side, and interposes the sheet S between the nip roller and the rear driving roller 32. In this manner, a friction force between the rear driving roller 32 and the sheet S is secured, and it is possible to reliably transport the sheet S using the rear driving roller 32.

In this manner, the sheet S which is transported from the front driving roller 31 to the rear driving roller 32 is supported by the outer peripheral surface of the platen drum 30. In addition, the process unit 3 is provided with a plurality of recording heads 51 corresponding to colors which are different from each other in order to record a color image on the front surface of the sheet S which is supported by the platen drum 30. Specifically, four recording heads 51 corresponding to a yellow color, a cyan color, a magenta color, and a black color are aligned in the transport direction Ds in this order of the colors. Each recording head 51 faces the front surface of the sheet S which is wound around the platen drum 30 with a little clearance, and ejects ink (color ink) of a corresponding color from nozzles in an ink jet method. In addition, a color image is formed on the front surface of the sheet S when each recording head 51 ejects ink on the sheet S which is transported in the transport direction Ds.

Incidentally, Ultraviolet (UV) ink (photocurable ink) which is cured by being irradiated with ultraviolet rays (light) is used as ink. Therefore, UV irradiators 61 and 62 (light irradiation unit) are provided in the process unit 3 in order to fix ink onto the sheet S by curing the ink. In addition, curing of the ink is executed in two stages of temporary curing and main curing. The UV irradiator 61 for temporary curing is arranged between each of the plurality of recording heads 51. That is, the UV irradiator 61 cures ink to an extent of not being collapsed in shape (temporary curing) by irradiating weak UV rays, and does not cure ink completely. On the other hand, the UV irradiator 62 for main curing is provided on the downstream side in the transport direction Ds with respect to the plurality of recording heads 51. That is, the UV irradiator 62 completely cures (main curing) ink by irradiating UV rays which are stronger than those of the UV irradiator 61.

In this manner, the UV irradiator 61 which is arranged between each of the plurality of recording heads 51 temporarily cures color ink which is ejected onto the sheet S from the recording head 51 on the upstream side in the transport direction Ds. Accordingly, ink which is ejected onto the sheet S from one recording head 51 is temporarily cured until reaching a recording head 51 which is neighboring to the one recording head 51 on the downstream side in the transport direction Ds. In this manner, it is possible to suppress occurrence of color mixing in which color inks of different colors are mixed. A color image is formed on the sheet S when the plurality of recording heads 51 eject ink of colors which are different from each other in a state of suppressing the color mixing in this manner. In addition, the UV irradiator 62 for main curing is provided on the further downstream side in the transport direction Ds than the plurality of recording heads 51. For this reason, the color image which is formed using the plurality of recording heads 51 is fixed onto the sheet S by being subject to main curing by the UV irradiator 62.

In addition, a recording head 52 is provided on the downstream side in the transport direction Ds with respect to the UV irradiator 62. The recording head 52 faces the front surface of the sheet S which is wound around the platen drum 30 with a little clearance, and ejects transparent UV ink onto the front surface of the sheet S from nozzles in an ink jet method. That is, the transparent ink is further ejected onto the color image which is formed using the recording heads 51 of four colors. The transparent ink is ejected onto the entire surface of the color image, and gives the color image texture such as glossiness, or a mat look. In addition, a UV irradiator 63 is provided on the downstream side in the transport direction Ds with respect to the recording head 52. The UV irradiator 63 completely cures (main curing) the transparent ink which is ejected from the recording head 52 by irradiating strong UV rays. In this manner, it is possible to fix the transparent ink onto the front surface of the sheet S.

In this manner, the color image which is coated with the transparent ink is formed on the sheet S which is wound around the outer peripheral portion of the platen drum 30 by appropriately performing ejecting and curing of ink in the process unit 3. In addition, the sheet S on which the color image is formed is transported to the winding unit 4 by the rear driving roller 32.

The winding unit 4 includes a driven roller 41 which winds up the sheet S from the rear surface side between the winding shaft 40 and the rear driving roller 32, in addition to the winding shaft 40. The winding shaft 40 supports an end of the sheet S by winding up in a state in which the front surface of the sheet S faces outside. That is, when the winding shaft 40 rotates clockwise as illustrated in FIG. 1, the sheet S which is transported from the rear driving roller 32 is wound around the winding shaft 40 through the driven roller 41. That is, the sheet S is wound around the winding shaft 40 through a core tube 42 which is detachable from the winding shaft 40. Accordingly, when the sheet S which is wound around the winding shaft 40 (windup roll R40) is full, it is possible to detach the sheet S together with the core tube 42.

Figure 2:
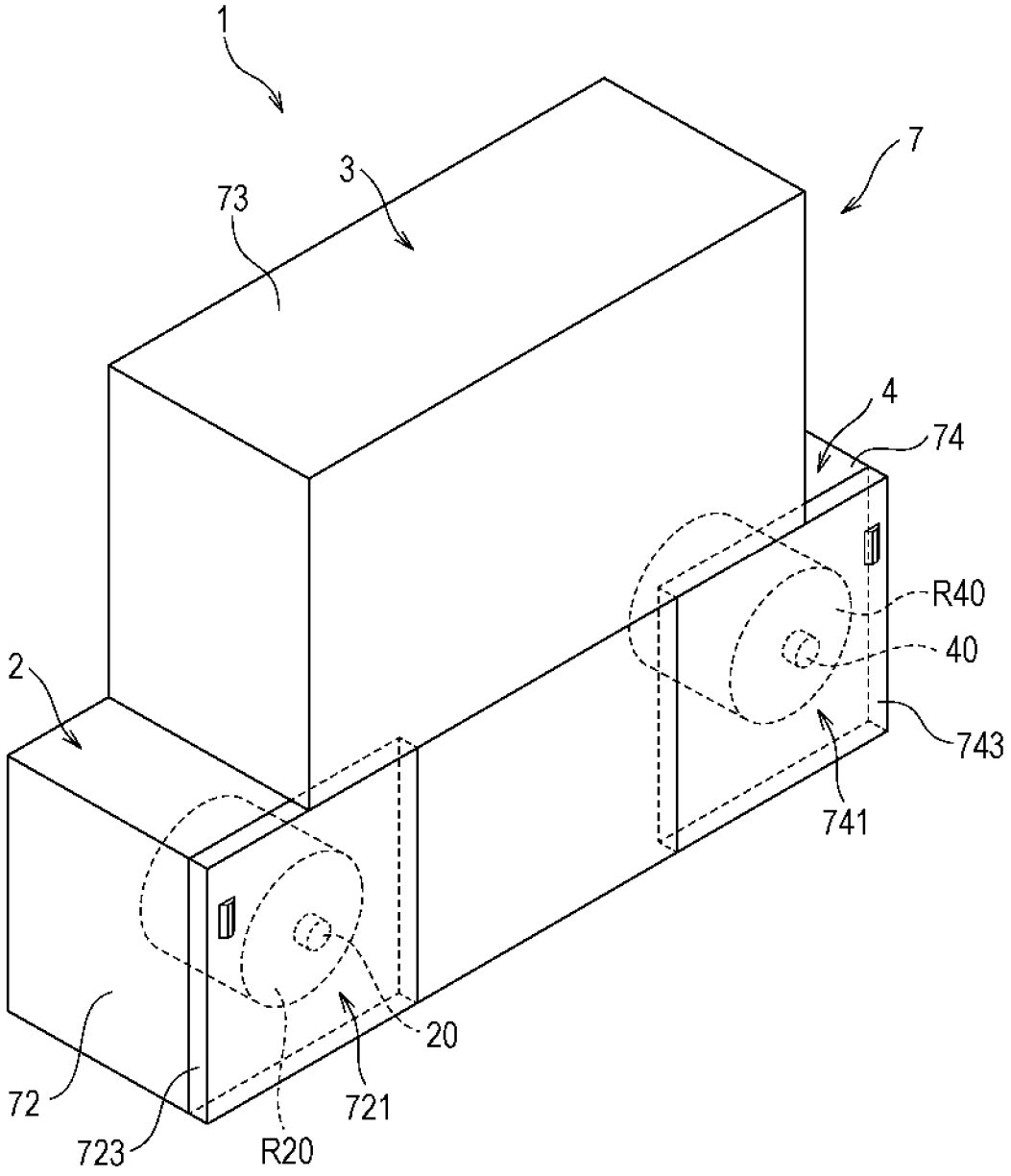
FIG. 2 is a perspective view which illustrates an external configuration of the printer illustrated in FIG. 1.

FIG. 2 is a perspective view which illustrates an example of an external configuration of the printer in FIG. 1. In FIG. 2, only the feeding shaft 20, the winding shaft 40, the feed roll R20, and the windup roll R40 are denoted by dotted lines in the internal configuration of the printer 1. As illustrated in FIG. 2, the printer 1 includes a housing member 7 (external member) which accommodates each unit illustrated in FIG. 1. The housing member 7 is configured of a feeding unit cover 72 which is provided on the left side in FIG. 2, and mainly covers the feeding unit 2, a process unit cover 73 which is provided in a center in FIG. 2, and mainly covers the process unit 3, and a winding unit cover 74 which is provided on the right side in FIG. 2, and mainly covers the winding unit 4.

The feeding unit cover 72 accommodates the feeding shaft 20 and the feed roll R20. An opening portion 721 opens on the front side of the feeding unit cover 72 by facing the feeding shaft 20 and the feed roll R20. In addition, a feeding unit door 723 which opens and shuts the opening portion 721 is provided on the front side of the feeding unit cover 72. Accordingly, when opening the feeding unit door 723, a worker can perform a work such as exchanging of the feed roll R20 with respect to the feeding shaft 20 by accessing the feeding unit 2. On the other hand, by shutting the feeding unit door 723, access to the feeding unit 2 by the worker can be prevented.

The winding unit cover 74 accommodates the winding shaft 40 and the windup roll R40. An opening portion 741 opens on the front side of the winding unit cover 74 by facing the winding shaft 40 and the windup roll R40. In addition, a winding unit door 743 which opens and shuts the opening portion 741 is provided on the front side of the winding unit cover 74. Accordingly, when opening the winding unit door 743, a worker can perform a work such as exchanging of the windup roll R40 with respect to the winding shaft 40 by accessing the winding unit 4. On the other hand, by shutting the winding unit door 743, access to the winding unit 4 by the worker can be prevented.

Figure 3:
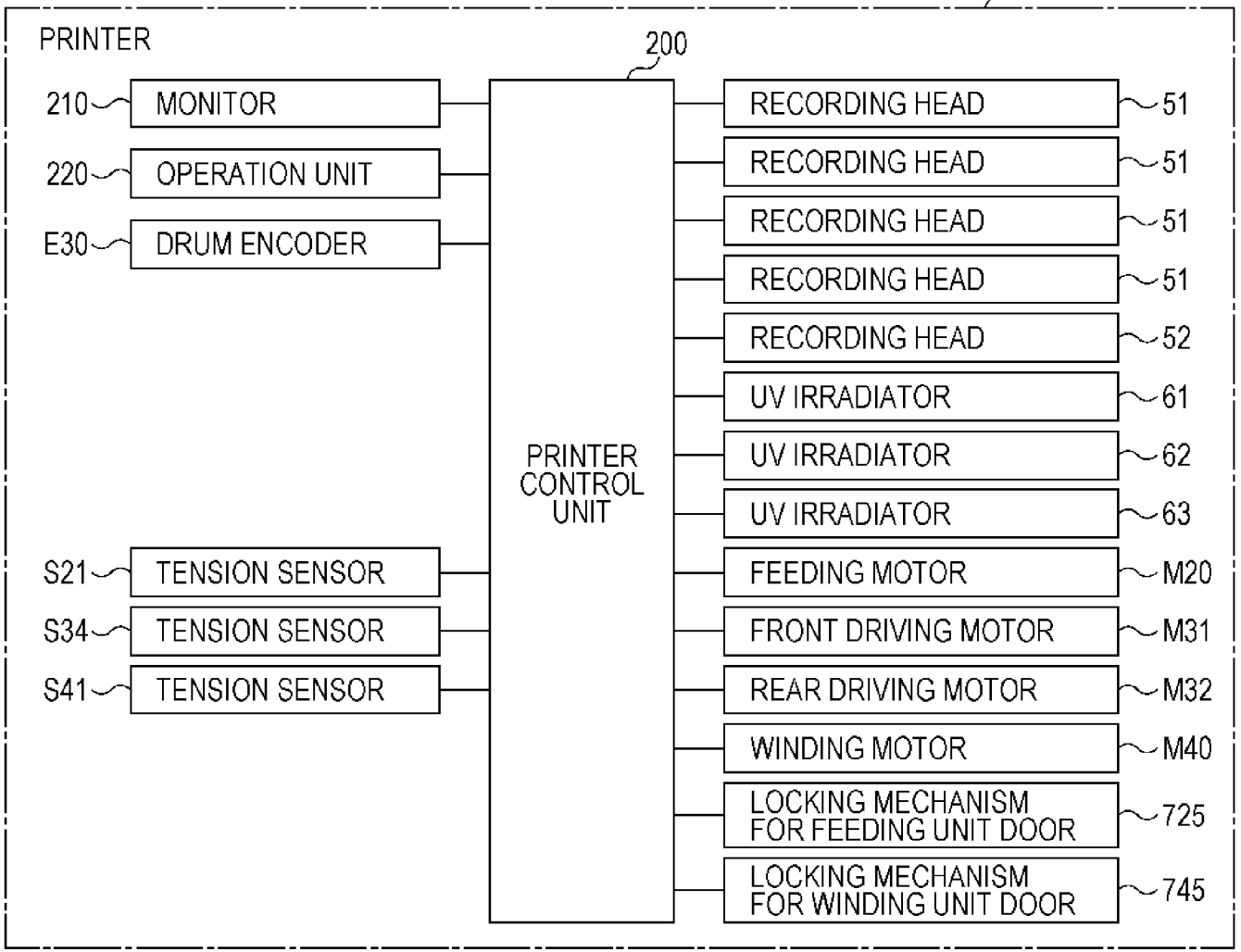
FIG. 3 is a block diagram which illustrates an electrical configuration which controls the printer illustrated in FIG. 1.

Hitherto, a schematic apparatus configuration of the printer 1 has been described. Subsequently, an electrical configuration for controlling the printer 1 will be described. FIG. 3 is a block diagram which schematically illustrates an electrical configuration for controlling the printer in FIG. 1. As illustrated in FIG. 3, a printer control unit 200 which controls each unit of the printer 1 is provided in the printer 1. Specifically, the printer control unit 200 is a computer which is configured of a Central Processing Unit (CPU), or a memory.

The printer 1 is provided with a monitor 210 which is configured of a liquid crystal display, or the like, as an interface between a worker and the printer control unit 200, and an operation unit 220 which is configured of a keyboard, a mouse, or the like. A menu screen is displayed on the monitor 210, in addition to an image as a printing target. Accordingly, a worker can set various printing conditions such as a type of a printing medium, a size of the printing medium, and a printing quality by opening a printing setting screen from the menu screen, by operating the operation unit 220 while confirming on the monitor 210. In addition, the worker can also perform an input of instructing an execution of image forming, an input which informs of performing an exchanging work of the feed roll R20 or the windup roll R40, or the like, with respect to the printer control unit 200 through the monitor 210, or the operation unit 220. In addition, a specific configuration of the interface with the worker can be variously modified, and the operation unit 220 may be configured of a touch panel of the monitor 210, using a touch panel display as the monitor 210, for example. In addition, the printer control unit 200 controls each unit of the printer 1 as follows according to an input from the worker.

The printer control unit 200 controls an ink ejecting timing of each of the recording heads 51 which forms a color image according to a transport of the sheet S. Specifically, the control of the ink ejecting timing is performed based on an output of a drum encoder E30 (detection value) which is attached to a rotational shaft of the platen drum 30, and detects a rotating position of the platen drum 30. That is, since the platen drum 30 rotates along with the transport of the sheet S in a driven manner, it is possible to ascertain a transport position of the sheet S by referring to an output of the drum encoder E30 which detects a rotating position of the platen drum 30. Therefore, the printer control unit 200 forms a color image by causing ink which is ejected from each recording head 51 to be landed on a target position of the transported sheet S, by generating a print timing signal (pts) from the output of the drum encoder E30, and controlling an ink ejecting timing of each recording head 51 based on the pts signal.

In addition, also a timing of ejecting the transparent ink by the recording head 52 is controlled by the printer control unit 200 based on an output of the drum encoder E30, similarly. In this manner, it is possible to accurately eject the transparent ink with respect to a color image which is formed by the plurality of recording heads 51. In addition, a timing of ON-OFF of the UV irradiators 61, 62, and 63, or an irradiation light amount is also controlled by the printer control unit 200.

The printer control unit 200 also controls locking states of the feeding unit door 723 and the winding unit door 743 which are illustrated in FIG. 2. That is, a locking mechanism for feeding unit door 725 for executing locking and unlocking of the feeding unit door 723 is provided in the feeding unit cover 72. Accordingly, an operation of opening a shut feeding unit door 723 is prevented while the locking mechanism for feeding unit door 725 is locking the feeding unit door 723, and is possible only when the locking mechanism for feeding unit door 725 has unlocked the feeding unit door 723. In addition, locking and unlocking of the feeding unit door 723 can be performed when the printer control unit 200 controls the locking mechanism for feeding unit door 725. Similarly, a locking mechanism for winding unit door 745 for executing locking and unlocking of the winding unit door 743 is provided in the winding unit cover 74. Accordingly, an operation of opening a shut winding unit door 743 is prevented while the locking mechanism for winding unit door 745 is locking the winding unit door 743, and is possible only when the locking mechanism for winding unit door 745 has unlocked the winding unit door 743. In addition, locking and unlocking of the winding unit door 743 is performed when the printer control unit 200 controls the locking mechanism for winding unit door 745.

In addition, the printer control unit 200 conducts a function of controlling the transport of the sheet S which is described in detail in FIG. 1. That is, a motor is connected to the respective feeding shaft 20, the front driving roller 31, the rear driving roller 32, and the winding shaft 40 among members which configure a sheet transport system. In addition, the printer control unit 200 controls the transport of the sheet S by controlling a speed or a torque of each motor while rotating these motors. The control of the transport of the sheet S will be described in detail below.

The printer control unit 200 supplies the sheet S from the feeding shaft 20 to the front driving roller 31 by rotating a feeding motor M20 which drives the feeding shaft 20. At this time, the printer control unit 200 controls a torque of the feeding motor M20, and adjusts a tension of the sheet S from the feeding shaft 20 to the front driving roller 31 (feeding tension Ta). That is, a tension sensor S21 which detects the feeding tension Ta is attached to the driven roller 21 which is arranged between the feeding shaft 20 and the front driving roller 31. The tension sensor S21 can be configured of, for example, a load cell which detects a power which is received from the sheet S. In addition, the printer control unit 200 performs a feedback control of the torque of the feeding motor M20 based on a detection result of the tension sensor S21, and adjusts the feeding tension Ta of the sheet S.

In addition, the printer control unit 200 rotates a front driving motor M31 which drives the front driving roller 31, and a rear driving motor M32 which drives the rear driving roller 32. In this manner, the sheet S which is fed from the feeding unit 2 passes through the process unit 3. At this time, a speed control is performed with respect to the front driving motor M31, and on the other hand, a torque control is performed with respect to the rear driving motor M32. That is, the printer control unit 200 constantly adjusts a rotating speed of the front driving motor M31 based on an encoder output of the front driving motor M31. In this manner, the sheet S is transported at a constant speed by the front driving roller 31.

On the other hand, the printer control unit 200 controls a torque of the rear driving motor M32, and adjusts a tension of the sheet S from the front driving roller 31 to the rear driving roller 32 (process tension Tb). That is, a tension sensor S34 which detects the process tension Tb is attached to a driven roller 34 which is arranged between the platen drum 30 and the rear driving roller 32. The tension sensor S34 can be configured of, for example, a load cell which detects a power which is received from the sheet S. In addition, the printer control unit 200 performs a feedback control of the torque of the rear driving motor M32 based on a detection result of the tension sensor S34, and adjusts the process tension Tb of the sheet S.

In addition, the printer control unit 200 rotates a winding motor M40 which drives the winding shaft 40, and winds the sheet S which is transported by the rear driving roller 32 around the winding shaft 40. At this time, the printer control unit 200 controls a torque of the winding motor M40, and adjusts a tension of the sheet S from the rear driving roller 32 to the winding shaft 40 (winding tension Tc). That is, a tension sensor S41 which detects the winding tension Tc is attached to the driven roller 41 which is arranged between the rear driving roller 32 and the winding shaft 40. The tension sensor S41 can be configured of, for example, a load cell which detects a power which is received from the sheet S. In addition, the printer control unit 200 performs a feedback control of the torque of the winding motor M40 based on a detection result of the tension sensor S41, and adjusts the winding tension Tc of the sheet S.

Figure 4:
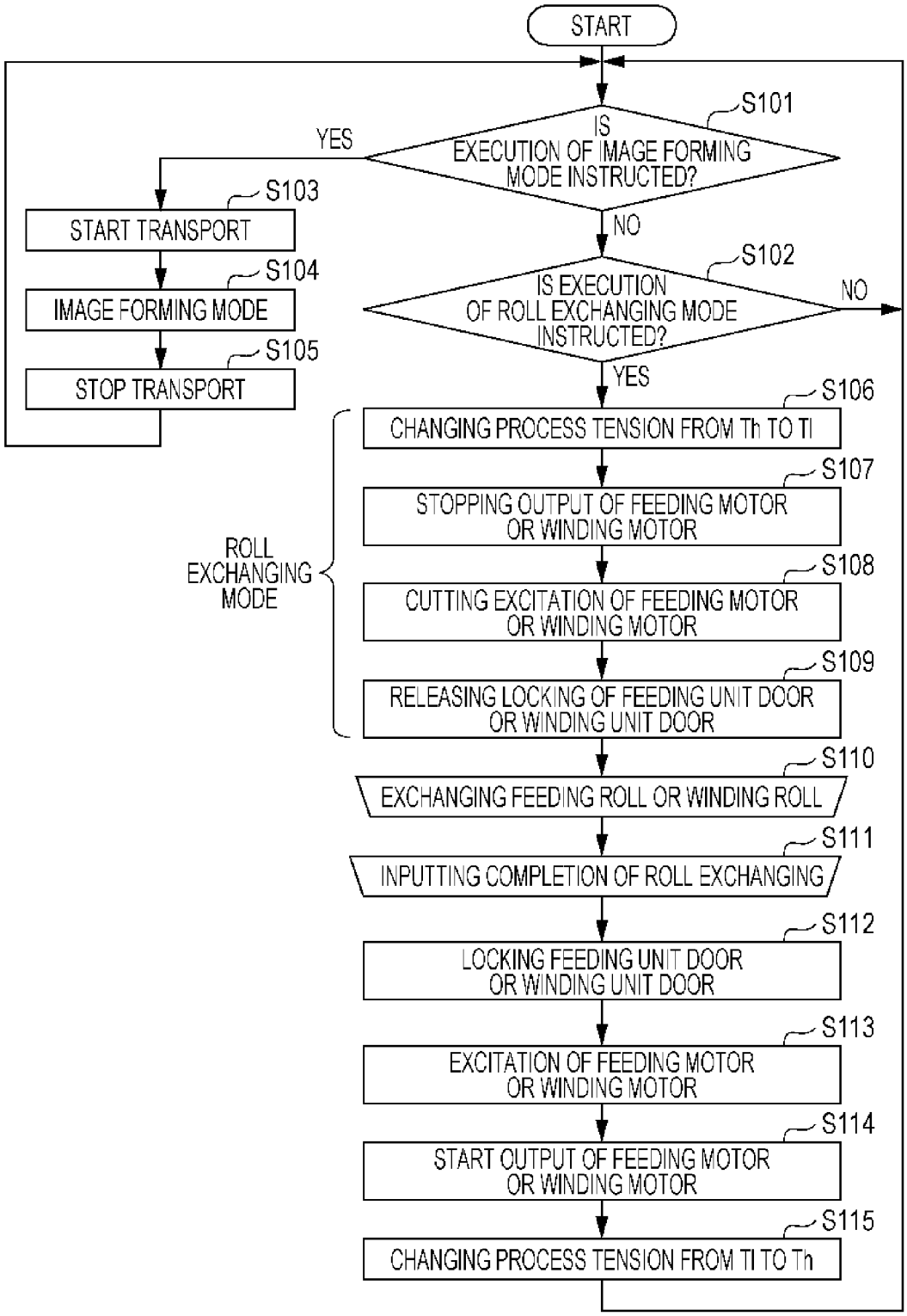
FIG. 4 is a flowchart which illustrates operations which can be executed in the printer illustrated in FIG. 1.

FIG. 4 is a flowchart which illustrates an example of operations which can be executed in the printer in FIG. 1, and specifically exemplifies a case in which the printer control unit 200 executes an image forming mode, or a roll exchanging mode from a standby state. That is, the printer control unit 200 confirms a presence or absence of an input denoting an instruction of executing an image forming mode, or an input denoting an instruction of executing a roll changing mode in the standby state (steps S101 and S102). In addition, when there is any input, the printer control unit 200 executes the mode. Incidentally, in the standby state, either the feeding unit door 723, or the winding unit door 743 is shut and locked.

In step S101, whether or not there is the input of instructing executing of the image forming mode from a worker through the monitor 210, or the operation unit 220 is confirmed. In addition, when there is the input of instructing executing of the image forming mode (Yes in step S101), steps S103 to S105 are sequentially executed. Specifically, in step S103, the transport of the sheet S is started. The transport of the sheet is executed while applying predetermined tensions Ta, Tb, and Tc to the sheet S in each of the feeding unit 2, the process unit 3, and the winding unit 4. In this manner, it is possible to stably transport the sheet S from the feeding shaft 20 to the winding shaft 40, and it is possible to securely support the sheet S using the platen drum 30 by causing the sheet S to come into close contact with the platen drum 30, in the process unit 3. As a result, it is possible to stably perform image forming on the sheet S. Specifically, the process tension Tb which is applied to the sheet S in the process unit 3 is set to a tension for image forming Th which is relatively large. In this manner, it is possible to perform image forming on the sheet S in a state in which the sheet S is stably supported by the platen drum 30 by causing the sheet S to come into close contact with the platen drum 30.

When a speed of transporting the sheet S which is started in step S103 becomes stable at a predetermined transport speed for image forming, the image forming mode in step S104 is executed, and image forming is performed when the recording heads 51 and 52, and the UV irradiators 61 to 63 are operated using the above described manner. In addition, when the image forming mode in step S104 is completed, the transport of the sheet S is stopped in step S105. At this time, each tension Ta, Tb, and Tc which is applied to the sheet S after stopping is the same as each tension Ta, Tb, and Tc which is applied to the sheet S while executing the image forming mode. Accordingly, in a standby state, the process tension Tb which is applied to the sheet S becomes the tension for image forming Th. When steps S103 to 105 are finished, the printer control unit 200 returns to the standby state (steps S101 and S102). In addition, both the feeding unit door 723 and the winding unit door 743 are shut and locked during executing of steps S103 to S105.

In step S101, when it is determined that there is no input of instructing executing of the image forming mode (determining as No), the process proceeds to step S102, and whether or not there is an input of instructing executing of the roll changing mode from a worker through the monitor 210, or the operation unit 220 is confirmed. When there is no input of instructing executing of the roll changing mode (No in step S102), the printer control unit 200 returns to step S101, and is in a standby state.

On the other hand, when there is the input of instructing executing of the roll changing mode (Yes in step S102), the printer control unit 200 executes the roll changing mode in steps S106 to S109. That is, a worker can inform the printer control unit 200 of performing exchanging of the feed roll R20 or the windup roll R40 by performing the input. In addition, when the printer control unit 200 which received the information executes the roll changing mode, a preparation for exchanging the feed roll R20 or the windup roll R40 is completed.

Incidentally, a worker can instruct the roll exchange while specifying a roll to be exchanged between the feed roll R20 and the windup roll R40. With respect to this, a series of operations which is executed by receiving the instruction (steps S106 to S115) is basically the same even though operation targets are different between the roll R20 and the roll R40. Therefore, in the following descriptions, points when a worker informs of exchanging of the windup roll R40 will be described, after describing a case in which the worker informs of exchanging of the feed roll R20.

In step S106, the process tension Tb is changed from the tension for image forming Th to a tension for detaching medium Tl. The tension for detaching medium Tl is set to a value which is smaller than the tension for image forming Th, and is larger than zero (Th>Tl>0). By applying the tension for detaching medium Tl to the sheet S of the process unit 3, it is possible to suppress the process tension Tb of the sheet S to be low while causing the sheet S to come into close contact with the platen drum 30. In step S107, an output of the feeding motor M20 is stopped. In this manner, the torque which is applied to the feeding shaft 20 by the feeding motor M20 is lost (become zero), and the feeding tension Ta is released (Ta=0). In addition, even after the releasing of the feeding tension Ta, the process tension Tb which is set to the tension for detaching medium Tl is continuously applied to the sheet S in the process unit 3. In addition, subsequent to cutting of the excitation of the feeding motor M20 in step S108, locking of the feeding unit door 723 is released in step S109 (that is, unlocked). In this manner, when the roll exchanging mode is completed, the worker can access the feeding unit 2 by opening the feeding unit door 723.

That is, in step S110, the worker detaches the sheet S from the feeding shaft 20 by accessing the feeding shaft 20 of the feeding unit 2, and mounts a new feed roll R20 on the feeding shaft 20. In addition, the worker connects an end of the sheet S which is detached from the feeding shaft 20 to an end of the feed roll R20 which is newly mounted on the feeding shaft 20, and shuts the feeding unit door 723. In this manner, exchanging of the feed roll R20 which is supported by the feeding shaft 20 is completed. In the subsequent step S111, the worker performs an input denoting that the exchanging of the feed roll R20 is completed with respect to the printer control unit 200 through the monitor 210, or the operation unit 220.

When receiving the input denoting the completion of roll exchanging from the worker, the printer control unit 200 excites the feeding motor M20 in step S113, after locking the feeding unit door 723 in step S112. In the subsequent step S114, an output of the feeding motor M20 is started, and the process tension Tb is applied to the sheet S of the feeding unit 2. A feeding tension Ta at this time has the same magnitude as the feeding tension Ta in the image forming mode. In addition, the printer control unit 200 changes the process tension Tb from the tension for detaching medium Tl to the tension for image forming Th (step S115), and returns to a standby state.

Hitherto, contents of steps S106 to S115 in a case of being informed of exchanging of the feed roll R20 by the worker has been described. As described above, contents of steps S106 to S115 in a case of being informed of exchanging of the windup roll R40 by the worker are also the same. That is, the output of the winding motor M40 is stopped in step S107 after the process tension Tb is reduced to the tension for detaching medium Tl in step S106, and then the winding tension Tc is released. In addition, the excitation of the winding motor M40 is cut (step S108), and the winding unit door 743 is unlocked (step S109). In this manner, the roll exchanging mode is executed.

When the roll exchanging mode is completed, and access to the winding unit 4 becomes possible, the worker detaches the windup roll R40 from the winding shaft 40 in step S110, attaches the end of the sheet S which is drawn in from the process unit 3 to the winding shaft 40 in a roll shape, and shuts the winding unit door 743. Subsequently, when the worker performs an input denoting that the roll exchange is completed (step S111), the winding unit door 743 is locked (step S112), and the winding motor M40 is excited (step S113). In addition, an output of the winding motor M40 is started, and the same winding tension Tc as the image forming mode is applied to the sheet S of the winding unit 4 (step S114). Finally, the printer control unit 200 increases the process tension Tb to the tension for image forming Th (step S115), and returns to a standby state.

As described above, in the printer 1 according to the embodiment, the recording heads 51 and 52 perform image forming on the sheet S which is supported by the platen drum 30 in a state in which the tension for image forming Th is applied to the sheet S of the process unit 3, while the feeding tension Ta is applied to the sheet S of the feeding unit 2. At this time, the tension for image forming Th is not only generated by the torque of the front driving roller 31, and is also subsidiarily generated by the torque of the feeding shaft 20. That is, the tension for image forming Th is applied to the sheet S when the torques of the front driving roller 31 and the feeding shaft 20 resist the torques of the rear driving roller 32 and the winding shaft 40 in collaboration. As a result, it is possible to apply a large tension for image forming Th to the sheet S which is supported by the platen drum 30 without applying such a large torque to the front driving roller 31, and to perform good image forming.

In addition, in the printer 1 according to the embodiment, it is possible to release the tension of the sheet S in the feeding unit 2, in a state in which the sheet S is stopped, while applying the tension for detaching medium Tl which is smaller than the tension for image forming Th to the sheet S in the process unit 3 (roll exchanging mode). In the roll exchanging mode, releasing of the tension of the sheet S in the feeding unit 2 is executed, in a state in which a tension for detaching medium Tl which is relatively small is applied to the sheet S in the process unit 3. Accordingly, when releasing the tension of the sheet S in the feeding unit 2, a tension to be resisted by the front driving roller 31 is a tension for detaching medium Tl which is smaller than the tension for image forming Th. For this reason, it is possible for the front driving roller 31 to suppress a deviation of the sheet S by resisting the tension which is applied to the sheet S on the platen drum 30 (tension for detaching medium Tl), even when the front driving roller 31 looses the support from the feeding shaft 20 along with releasing of the tension in the feeding unit 2.

In addition, in the printer 1 according to the embodiment, the recording heads 51 and 52 perform image forming on the sheet S which is supported by the platen drum 30 in a state in which the tension for image forming Th is applied to the sheet S in the process unit 3 while the winding tension Tc is applied to the sheet S in the winding unit 4. At this time, the tension for image forming Th is not only generated by the torque of the rear driving roller 32, and is also subsidiarily generated by the torque of the winding shaft 40. That is, the tension for image forming Th is applied to the sheet S when the torques of the rear driving roller 32 and the winding shaft 40 resist the torques of the front driving roller 31 and the feeding shaft 20 in collaboration. As a result, it is possible to apply a large tension for image forming Th to the sheet S which is supported by the platen drum 30 without applying such a large torque to the rear driving roller 32, and to perform good image forming.

In addition, in the printer 1 according to the embodiment, it is possible to release the tension of the sheet S in the winding unit 4, in a state in which the sheet S is stopped, while applying the tension for detaching medium Tl which is smaller than the tension for image forming Th to the sheet S in the process unit 3 (roll exchanging mode). In the roll exchanging mode, releasing of the tension of the sheet S in the winding unit 4 is executed, in a state in which a tension for detaching medium Tl which is relatively small is applied to the sheet S in the process unit 3. Accordingly, when releasing the tension of the sheet S in the winding unit 4, a tension to be resisted by the rear driving roller 32 is a tension for detaching medium Tl which is smaller than the tension for image forming Th. For this reason, it is possible for the rear driving roller 32 to suppress a deviation of the sheet S by resisting the tension which is applied to the sheet S on the platen drum (tension for detaching medium Tl), even when the rear driving roller 32 looses the support from the winding shaft 40 along with releasing of the tension in the winding unit 4.

As described above, in the printer 1 according to the embodiment, it is possible to perform good image forming by applying a large tension for image forming Th to the sheet S which is supported by the platen drum 30 when performing image forming. On the other hand, when detaching the sheet S from the rotational shafts 20 and 40, it is possible to detach the sheet S while suppressing a deviation of the sheet S which is associated with releasing of the tension of the sheet S, by executing the roll exchanging mode. As a result, it is possible to suppress a deviation of the sheet S when detaching the sheet S from the rotational shafts 20 and 40 supporting the sheet S which is wound in a roll shape, while executing good image forming by applying the tension for image forming Th to the sheet S which is supported by the platen drum 30.

In addition, according to the embodiment, during the execution of the roll exchanging mode, the door 723 or 743 is locked until the tension Ta or Tc of the sheet S in the feeding unit 2 or winding unit 4 in which the roll is exchanged is released. In addition, the door 723 or 743 is unlocked after releasing the tension Ta or Tc. With such a configuration, it is possible to prevent the worker from accessing the sheet S before the tension thereof is released. For this reason, it is possible to prevent the sheet S or the rotational shaft 20 or 40 from being damaged when the worker tries to forcibly detach the sheet S before releasing tension from the rotational shaft, for example.

In addition, according to the embodiment, the doors 723 and 743 are locked during the execution of the roll exchanging mode. With such a configuration, it is possible to prevent the worker from accessing the sheet S on which image forming is performed. For this reason, for example, it is possible to prevent the worker from disturbing the image forming on the sheet S by accessing the sheet S in the middle of image forming by mistake.

In addition, in the printer 1 according to the embodiment, the monitor 210, or the operation unit 220 which receives an input from the worker is provided. In addition, the medium detaching mode is executed when the monitor 210, or the operation unit 220 receives an input instructing executing of the medium detaching mode by the worker. With such a configuration, it is possible to perform releasing of the tension of the sheet S by executing the medium detaching mode at an appropriate timing which corresponds to detaching of the sheet S by the worker. For this reason, it is possible for the worker to improve workability.

In addition, according to the embodiment, the tension Ta or Tc is applied to the sheet S when the monitor 210, or the operation unit 220 receives an input denoting that exchanging of the sheet S with respect to the rotational shaft 20 or 40 is finished, after executing the medium detaching mode. In this manner, for example, when the worker finishes the exchanging work of mounting a new sheet S on the rotational shaft 20 or 40 after detaching the previous sheet S from the rotational shaft 20 or 40, it is possible to rapidly apply the tension Ta or Tc to the sheet S, and to be prepared for image forming to be executed thereafter.

In addition, according to the embodiment, the tension for image forming Th is applied to the sheet S in the process unit 3, when the monitor 210, or the operation unit 220 receives an input denoting that exchanging of the sheet S with respect to the rotational shaft 20 or 40 is completed, after executing the medium detaching mode. In this manner, for example, when the worker finishes an exchanging work of mounting a new sheet S on the rotational shaft 20 or 40 after detaching the previous sheet S from the rotational shaft 20 or 40, it is possible to rapidly apply the tension for image forming Th to the sheet S in the process unit 3, and to be prepared for image forming to be executed thereafter.

As described above, according to the embodiment, the printer 1 corresponds to an example of the "image forming apparatus" of the invention, the sheet S corresponds to an example of the "recording medium" in the invention, the platen drum 30 corresponds to an example of the "support member" of the invention, the recording head 51 or 52 corresponds to an example of the "head" of the invention, the process unit 3 corresponds to an example of the "second region" of the invention, the printer control unit 200 corresponds to an example of the "control unit" of the invention, the housing member 7 corresponds to an example of the "external member" of the invention, the feeding unit door 723 or the winding unit door 743 corresponds to an example of the "opening-shutting door" of the invention, the opening portion 721, or 741 corresponds to an example of the "opening portion" of the invention, the locking mechanism for feeding unit door 725, or the locking mechanism for winding unit door 745 corresponds to an example of the "locking mechanism" of the invention, and the monitor 210 and the operation unit 220 function as the "input unit" of the invention in collaboration.

In addition, the image forming mode in step S104 corresponds to an example of the "image forming mode" in the invention, the roll exchanging mode in steps S106 to S109 corresponds to an example of the "medium detaching mode" of the invention, the tension for image forming Th corresponds to an example of the "tension for image forming" of the invention, and the tension for detaching medium Tl corresponds to an example of the "tension for detaching medium" of the invention. In addition, when exchanging the feed roll R20, the feeding shaft 20 corresponds to an example of the "rotational shaft" of the invention, the front driving roller 31 corresponds to an example of the "driving roller" of the invention, the rear driving roller 32 and the winding shaft 40 function as the "holding unit" of the invention in collaboration, and the feeding unit 2 corresponds to the "first region" of the invention. When exchanging the windup roll R40, the winding shaft 40 corresponds to an example of the "rotational shaft" of the invention, the rear driving roller 32 corresponds to an example of the "driving roller" of the invention, the front driving roller 31 and the feeding shaft 20 function as the "holding unit" of the invention in collaboration, and the winding unit 4 corresponds to the "first region" of the invention.

In addition, the invention is not limited to the above described embodiment, and it is possible to add various modifications to the above described embodiment without departing from the scope of the invention. For example, in the embodiment, a case has been exemplified in which the invention is applied to the printer 1 in which the sheet S is transported by controlling a torque of the rear driving roller 32, while controlling a rotating speed of the front driving roller 31, in the image forming mode. However, it is also possible to apply the invention to the printer 1 in which the sheet S is transported by controlling a rotating speed of the rear driving roller 32, while controlling a torque of the front driving roller 31, in the image forming mode.

In addition, according to the embodiment, the process tension Tb in a standby state is set to the tension for image forming Th. However, a specific set value of the process tension Tb in the standby state is not limited to this. Therefore, the process tension Tb in the standby state may be set to the tension for detaching medium Tl, may be set to a value which is smaller than the tension for image forming Th and larger than the tension for detaching medium Tl, may be set to a value which is larger than the tension for image forming Th, or may be set to a value which is smaller than the tension for detaching medium Tl.

In addition, according to the embodiment, the tension Ta or Tc in the standby state is set to be the same as the tension Ta or Tc in the image forming mode. However, the tension Ta or Tc in the standby state may be set to be larger, or smaller than the tension Ta or Tc in the image forming mode.

In addition, the printer 1 according to the embodiment is configured so that a worker specifies a roll to be exchanged between the rolls R20 and R40, and instructs the printer control unit 200 to execute the roll exchanging mode. However, it is also possible to configure the printer 1 so that a worker instructs the printer control unit 200 to execute the roll exchanging mode without specifying a roll to be exchanged. In this case, the printer may be configured so that releasing of the tension can be executed while suppressing a deviation of the sheet S even when a worker exchanges any of the roll R20 or R40, by executing the roll exchanging mode in steps S106 to S109 in both the feeding unit 2 and winding unit 4.

In addition, a timing for executing opening or shutting, locking, unlocking, or the like, of the feeding unit door 723, or the winding unit door 743, is not limited to the above described example, and can be appropriately changed. In addition, it is also possible to apply the invention to a simple printer 1 not including its own locking mechanism of the feeding unit door 723, or the winding unit door 743.

In addition, in the roll exchanging mode, it is not essential to cut the excitation of the feeding motor M20 or the winding motor M40. Accordingly, it is also possible to finish the roll exchanging mode while exciting the feeding motor M20 or the winding motor M40.

What is claimed is:

1. An image forming apparatus comprising:

a first shaft which holds a roll of a recording medium that is wound in a roll shape;

a platen drum which supports a part of the recording medium which continues to the roll of the recording medium held by the first shaft;

a pair of rollers which nip the recording medium between the first shaft and the platen drum; and a control unit which applies a tension to the recording medium, wherein the control unit selectively executes a first mode in which the tension between the first shaft and the platen drum is applied, and a second mode in which the tension between the first shaft and the pair of rollers is released while applying the tension between the pair of rollers and the platen drum, tension between the pair of rollers and the platen drum in the second mode being less than a tension for image forming and greater than zero.

2. The image forming apparatus according to claim 1, further comprising:

a head which faces the platen drum, and performs image forming on the recording medium which is supported by the platen drum, wherein the head is caused to execute image forming in the first mode, and the roll of the recording medium is exchanged in the second mode.

3. The image forming apparatus according to claim 1, further comprising:

a holding unit which holds the roll of the recording medium on a side opposite to the pair of rollers with respect to the platen drum.

4. The image forming apparatus according to claim 3, wherein the roll of the recording medium is transported using a roll to roll method from the first shaft to the holding unit.

5. The image forming apparatus according to claim 1, further comprising:

an external member that accommodates the first shaft;

an opening-shutting door that opens or shuts an opening portion which is open to the first shaft, and that is provided in the external member; and a locking mechanism which locks the opening-shutting door.

6. The image forming apparatus according to claim 5, wherein the control unit locks the opening-shutting door during execution of the first mode.

7. The image forming apparatus according to claim 1, further comprising:

an input unit which receives an input from a worker, wherein the control unit executes the second mode when the input unit receives an input instructing execution of the second mode.

* * * * *